US008136267B2

(12) United States Patent
Barnett et al.

(10) Patent No.: US 8,136,267 B2
(45) Date of Patent: Mar. 20, 2012

(54) INSERT FOR EXPANDING AN ARTICLE OF CLOTHING

(75) Inventors: Ghamari Krista Barnett, Laurelton, NY (US); Kirk Wallance Barnett, Laurelton, NY (US)

(73) Assignee: Boot Band LLC, Laurelton, NY (US)

( * ) Notice: Subject to any disclaimer, the term of this patent is extended or adjusted under 35 U.S.C. 154(b) by 915 days.

(21) Appl. No.: 12/175,169

(22) Filed: Jul. 17, 2008

(65) Prior Publication Data

US 2009/0049710 A1 Feb. 26, 2009

Related U.S. Application Data

(60) Provisional application No. 60/961,150, filed on Jul. 18, 2007.

(51) Int. Cl.

| | |
|---|---|
| ***A43C 11/00*** | (2006.01) |
| ***A43C 11/12*** | (2006.01) |
| ***A43B 23/02*** | (2006.01) |
| ***A44B 19/04*** | (2006.01) |
| ***A44B 19/26*** | (2006.01) |
| ***A44B 19/28*** | (2006.01) |

(52) U.S. Cl. ..... 36/50.1; 36/45; 36/51; 24/416

(58) Field of Classification Search ..... 36/50.1, 36/51, 97, 45, 100, 109; 24/416

See application file for complete search history.

(56) References Cited

U.S. PATENT DOCUMENTS

| | | | | |
|---|---|---|---|---|
| 343,410 | A * | 6/1886 | Weld | 36/50.1 X |
| 587,483 | A * | 8/1897 | Hill | 36/51 |
| 664,044 | A * | 12/1900 | Hormann | 36/51 |
| 1,200,388 | A * | 10/1916 | Mason | 36/45 X |
| 1,349,572 | A * | 8/1920 | Hubbell | 36/50.1 X |
| 1,632,390 | A * | 6/1927 | Dietz | 36/50.1 |
| 1,642,737 | A * | 9/1927 | Martin | 36/50.1 |
| 1,684,660 | A * | 9/1928 | Blair | 36/50.1 |
| 1,765,096 | A * | 6/1930 | Reingold | 36/50.1 X |
| 1,771,004 | A * | 7/1930 | Van Dinter | 36/50.1 X |
| 1,777,137 | A * | 9/1930 | Blair | 36/50.1 X |
| 2,108,650 | A * | 2/1938 | Casey | 36/50.1 X |
| 2,159,816 | A * | 5/1939 | Murphy | 36/50.1 |
| 2,178,885 | A | 11/1939 | Buff et al. | |
| 2,287,877 | A * | 6/1942 | Hard | 36/50.1 |
| 2,437,765 | A * | 3/1948 | Statham | 36/50.1 X |
| 2,495,176 | A | 1/1950 | Nissen | |
| 2,666,996 | A * | 1/1954 | Odland | 36/50.1 |
| 2,973,589 | A * | 3/1961 | Rigsby | 36/50.1 X |
| 2,986,824 | A * | 6/1961 | Bingham, Jr. | 36/50.1 X |
| 3,059,352 | A * | 10/1962 | Clason | 36/50.1 |

(Continued)

FOREIGN PATENT DOCUMENTS

CA 2104496 A1 2/1995

(Continued)

*Primary Examiner* — Rodney B White

(74) *Attorney, Agent, or Firm* — Proskauer Rose LLP

(57) ABSTRACT

Systems and methods associated with an insert for expanding an article of clothing, including an article of footwear, are described. Articles of clothing incorporating such inserts are also described. The insert includes a body portion defining a first edge, a second edge, and a perimeter. Fasteners are disposed along the first and second edges. The fasteners couple to fastening structures of the article of clothing, and the perimeter of the body increases a size or circumference of the article of the clothing. The material for the insert, fasteners, fastening structures, or portions thereof can be selected to be decorative or to match, complement, correspond to, or coordinate with articles of clothing and/or accessories.

31 Claims, 9 Drawing Sheets

U.S. PATENT DOCUMENTS

| | | | | |
|---|---|---|---|---|
| 3,763,579 | A | 10/1973 | Dexter | |
| 3,855,715 | A | 12/1974 | Johnson | |
| 4,512,089 | A * | 4/1985 | Carrier | 36/50.1 X |
| 4,689,902 | A * | 9/1987 | Lewis, Jr. | 36/50.1 X |
| 4,829,683 | A * | 5/1989 | Chikamori et al. | 36/50.1 X |
| 6,604,477 | B1 * | 8/2003 | Hozan | 36/50.1 X |
| 2005/0034329 | A1 * | 2/2005 | Chen et al. | 36/45 |
| 2006/0185065 | A1 | 8/2006 | Allen | 2/237 |
| 2010/0287742 | A1 * | 11/2010 | Leveau | 24/416 |

FOREIGN PATENT DOCUMENTS

| | | | |
|---|---|---|---|
| DE | 19624553 | A1 | 1/1998 |
| DE | 20312365 | U1 | 1/2004 |
| DE | 10240785 | B4 | 5/2004 |
| EP | 1749454 | A | 2/2007 |
| FR | 2593356 | A1 | 7/1987 |
| SE | 530 254 | | 4/2008 |
| WO | 2008/054317 | | 5/2008 |

* cited by examiner

INSERT FOR EXPANDING AN ARTICLE OF CLOTHING

CROSS-REFERENCE TO RELATED APPLICATIONS

This application claims the benefit of U.S. Patent Application No. 60/961,150, titled "Boot Expander Attachment," which was filed Jul. 18, 2007, the entire content of which is hereby incorporated herein by reference.

TECHNICAL FIELD

The invention generally relates to clothing and apparel and specifically to inserts for expanding an article of clothing and articles of clothing including such inserts.

BACKGROUND

Articles of clothing are generally manufactured in different sizes. The various sizes allow people of various body sizes and shapes to wear the particular article of clothing. Some articles of clothing include a structure for fastening portions of the article of clothing together to secure a particular fit (e.g., a snug fit). Examples of these types of clothing include pants, shirts, jackets and boots.

Despite the variety of sizes of clothing, some people are not able to fit into some articles of clothing, for example, if the person is between sizes or if the person is larger than the largest available size for the article of clothing. In particular, articles of footwear such as boots present a unique problem for wearers whose bodies are not sized in the same way the boot is designed. For example, a person may have a foot size that is compatible with standard foot sizes, but the person may also have a larger calf than the leg-covering portion of the boot is designed to fit. More specifically, the circumference of the leg-covering portion of the boot, or opening, may be smaller than the circumference of the wearer's calf. Therefore, while the wearer's foot may fit within the boot, the wearer may not be able to close the leg-covering portion of the boot to fit about the wearer's calf. Previously, such a person would be required to forego wearing the boot or forcing the leg-covering portion to close about the calf. Forcing the leg-covering portion of the boot to close about the calf could lead to potential tightness in the wearer's leg from the leg-covering portion or pinched skin in the fastener. Stress on the fastener and potential ripping of the boot material or breakage of the fastener could also result from an overly tight leg-covering portion relative to the wearer's calf.

SUMMARY

The concepts described herein address these and other issues associated with articles of clothing, such as boots, that do not properly fit a portion of a wearer's body. In general, the invention solves the problems described herein using an insert that expands a size or circumference of the article of clothing. The insert is designed and manufactured to employ the fastening structure of the article of clothing to facilitate expansion, therefore minimizing any structural changes to the article of clothing and reducing or eliminating the need for specific tailoring of the article of clothing. The insert can be sold with the article of clothing or as a separate item for use with the article of clothing. The insert can be removable, allowing the wearer to use different size insert as the wearer's needs change (e.g., the wearer can obtain larger inserts if the wearer's leg increases in size or smaller inserts if the wearer's leg decreases in size (until the inserts are no longer necessary)).

In one aspect, the invention relates to an insert for an article of footwear. The article of footwear includes a leg-covering portion that defines an outer circumference and a closeable portion disposed relative to the outer circumference. The closeable portion has a fastening structure that secures the leg-covering portion about a leg of a wearer. The insert includes a body portion including a flexible material. The body portion defines a perimeter including a first edge and a second edge. A first fastener is disposed along the first edge and is securable to a first portion of the fastening structure of the leg-covering portion of the article of footwear. A second fastener is disposed along the second edge and is securable to a second portion of the fastening structure of the leg-covering portion of the article of footwear. The perimeter of the body portion increases a size of the outer circumference of the leg-covering portion when the first and second fasteners are secured to the fastener structure. Thus, the insert accommodates people with larger calves to wear and enjoy the article of footwear.

The fastener structure of the leg-covering portion of the article of footwear can include a zipper that has a first track and a second track. The first fastener includes a third zipper track and a first slider portion that couples the first and third zipper tracks. The second fastener includes a fourth zipper track and a second slider portion that couples the second and fourth zipper tracks. The first and second slider portions of the insert can each include a top component coupled to a bottom component by a hinge or pivot structure. The first hinge or pivot structure permits the first slider portion to open and facilitate coupling between the first and third zipper tracks, and the second hinge or pivot structure permits the second slider portion to open and facilitate coupling between the second and fourth zipper tracks. The first and second slider portions of the insert can each be standard zipper sliders that are added manually to the article by the wearer or added during the manufacturing process. In some embodiments, the third zipper track includes a first insert pin and the fourth zipper track includes a second insert pin.

In some embodiments, the flexible material of the body portion includes at least one of nylon, nylon canvas, an elastic material, a leather material, a spandex material, a cotton material, a cotton blend material, a LYCRA™ material, or any combination of these materials. The flexible material can also include a color, design or pattern selected to match, complement, correspond to, or coordinate with an article of clothing or an accessory. The first and second fasteners, in some embodiments, feature zippers, buttons, hooks, snaps, clasps, VELCRO™, laces or any combination of these. The body portion can include a second fastener structure disposed between the first and second edge of the insert. The second fastener structure and the fastener structure of the leg-covering portion of the article of footwear can be generally aligned when the insert is secured to the article of footwear.

The body portion can include an extensive region disposed between the first and second edges, and the extensive region can cover at least a portion of the fastener structure of the leg-covering portion of the article of footwear (e.g., the zipper slider of a boot zipper). In some embodiments, the insert includes an elongated portion coupled to the first edge and connectable to the second edge. The elongated portion is positioned about the outer circumference of the leg-covering portion when the first and second fasteners are secured to the fastener structure of the article of footwear. The body portion can define a leg-facing surface and an exterior-facing surface, which can comprise different materials. The exterior facing-surface of the insert can include a pocket. Some embodiments feature a leg-facing surface that includes a spandex material, a cotton material, a LYCRA™ material, an elastic material, or any combination of these materials or other stretchy or non-stretchy materials.

In some embodiments, the body portion includes an adornment portion that includes a structure facilitating removable coupling of ornamental items to the insert. The body portion can, in some embodiments, include a concealable portion disposed between the first and second edges. The concealable portion extends vertically past the outer circumference of the article of footwear and is foldable to fit between a leg-facing surface of the body portion and the leg of the wearer. The body portion can also include a concealing portion disposed between the first and second edges that extends vertically past the outer circumference of the article of footwear and is foldable over an exterior surface of the insert, an exterior surface of the leg-covering portion of the article of footwear, or both. The concealing portion can be detachably coupled to the body portion. The perimeter includes, in some embodiments, a top edge region generally aligned with the outer circumference of the leg-covering portion when the insert is secured to the fastener structure. The perimeter includes a bottom region remote from the top edge region, and the first and second edges form a decreasing taper from the top edge towards the bottom region.

The invention, in another aspect, relates to an article of footwear. The article of footwear includes a leg-covering portion that defines an outer circumference. The leg-covering portion includes a closeable portion disposed relative to the outer circumference and defines a fastening structure that includes a first portion and a second portion fastening together to secure the leg-covering portion about a leg of a wearer. The article of footwear also includes an insert that includes a body portion. The body portion includes a flexible material and defines a perimeter, a first edge and a second edge. A first fastener is disposed along the first edge and is securable to the first portion of the fastening structure of the leg-covering portion. A second fastening structure is disposed along the second edge and is securable to the second portion of the fastening structure of the leg-covering portion. The perimeter of the body portion increases a size of the outer circumference of the leg-covering portion when the first and second fasteners are secured to the fastening structure of the leg-covering portion.

In yet another aspect, the invention relates to an insert for an article of clothing that includes a body-covering portion and defines a first circumference and a closeable portion that has a fastening structure and is disposed relative to the circumference. The insert includes a body portion. The body portion includes a flexible material and defines a perimeter, a first edge, and a second edge. A first fastener is disposed along the first edge and is securable to a first portion of the fastening structure of the body-covering portion. A second fastener is disposed along the second-edge and is securable to a second portion of the fastening structure of the body-covering portion. The perimeter of the body portion increases a size of the circumference of the body-covering portion when the first and second fasteners are secured to the fastening structure.

The invention, in another aspect, relates to a method for manufacturing an insert for an article of footwear. The method involves forming a body portion from a flexible material. The body portion defines a perimeter that includes a first and second edge. The method involves selecting a first fastener that is coupleable to a first corresponding fastening structure of the article of footwear and securing the first fastener along the first edge. The method also involves selecting a second fastener that is coupleable to a second corresponding fastening structure of the article of footwear and securing the second fastener along the second edge.

In some embodiments, the body portion includes a vertical dimension and a horizontal dimension. The method involves associating the vertical dimension of the insert with a height of a leg-covering portion of the article of footwear and associating the horizontal dimension of the insert with a circumference of a leg of a wearer of the article of footwear.

The invention, in yet another aspect, relates to a device. The device includes a first component that includes a first opening disposed relative to a smaller second opening. The first opening receives two uncoupled zipper structures, and the second opening passes coupled zipper structures therethrough. The device includes a first pivot and a second pivot generally axially aligned with the first pivot and spaced therefrom. The first and second pivots are disposed relative to the first component. The device includes a second component that includes a pull structure to move the device along the zipper structures in response to urging by a user. The second component is coupled to the first and second pivots to facilitate opening or closing the device about the first and second pivots.

In some embodiments, the first and second pivots are formed integrally with the first or second component.

In other embodiments of the invention, any of the aspects above can include one or more of the above features. One embodiment of the invention can provide all of the above features and advantages.

These and other features will be more fully understood by reference to the following description and drawings, which are illustrative and not necessarily to scale.

DETAILED DESCRIPTION

Figure 1A:
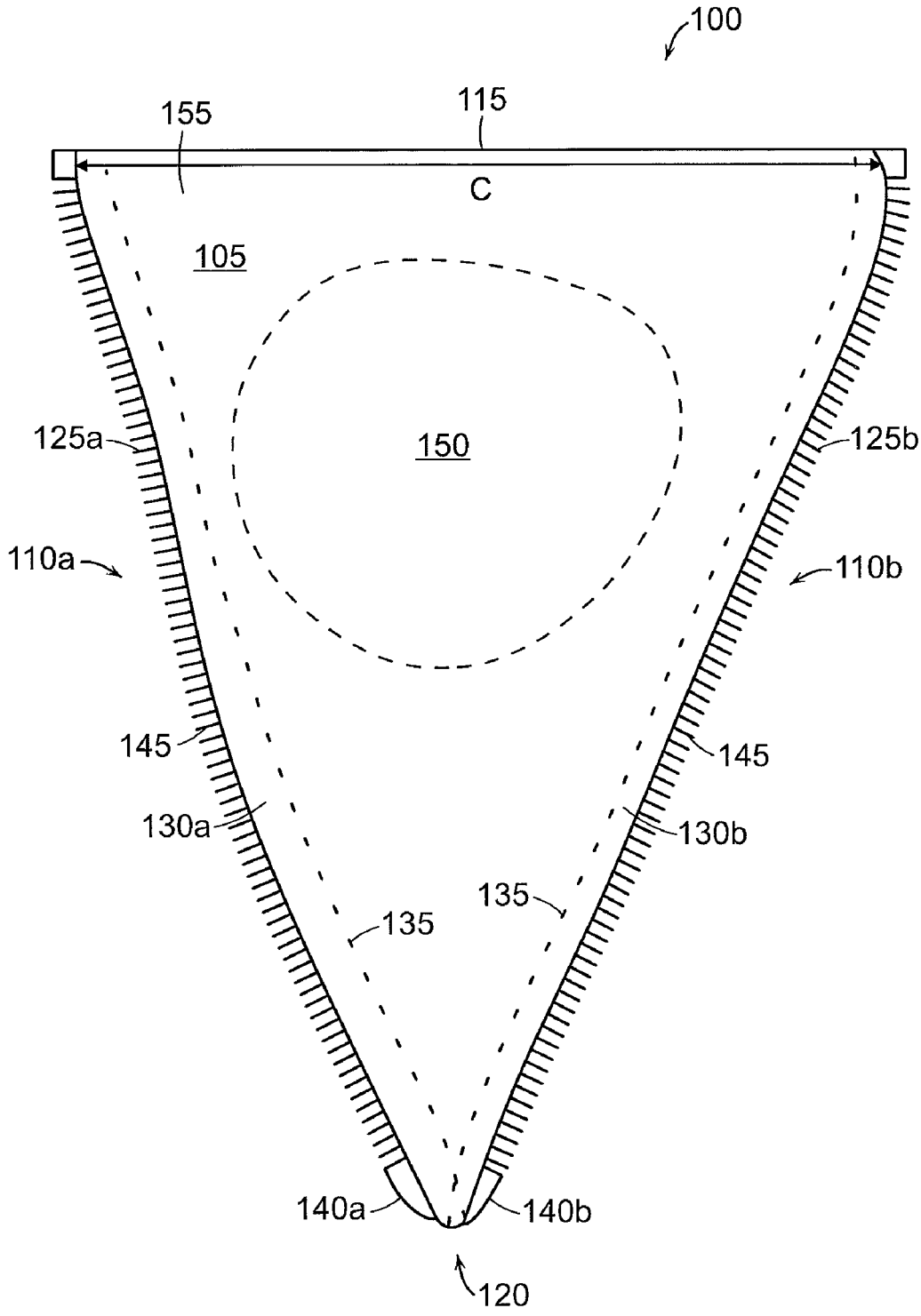
FIGS. 1A and 1B are plan views of an insert that embodies the invention.
Figure 1B:
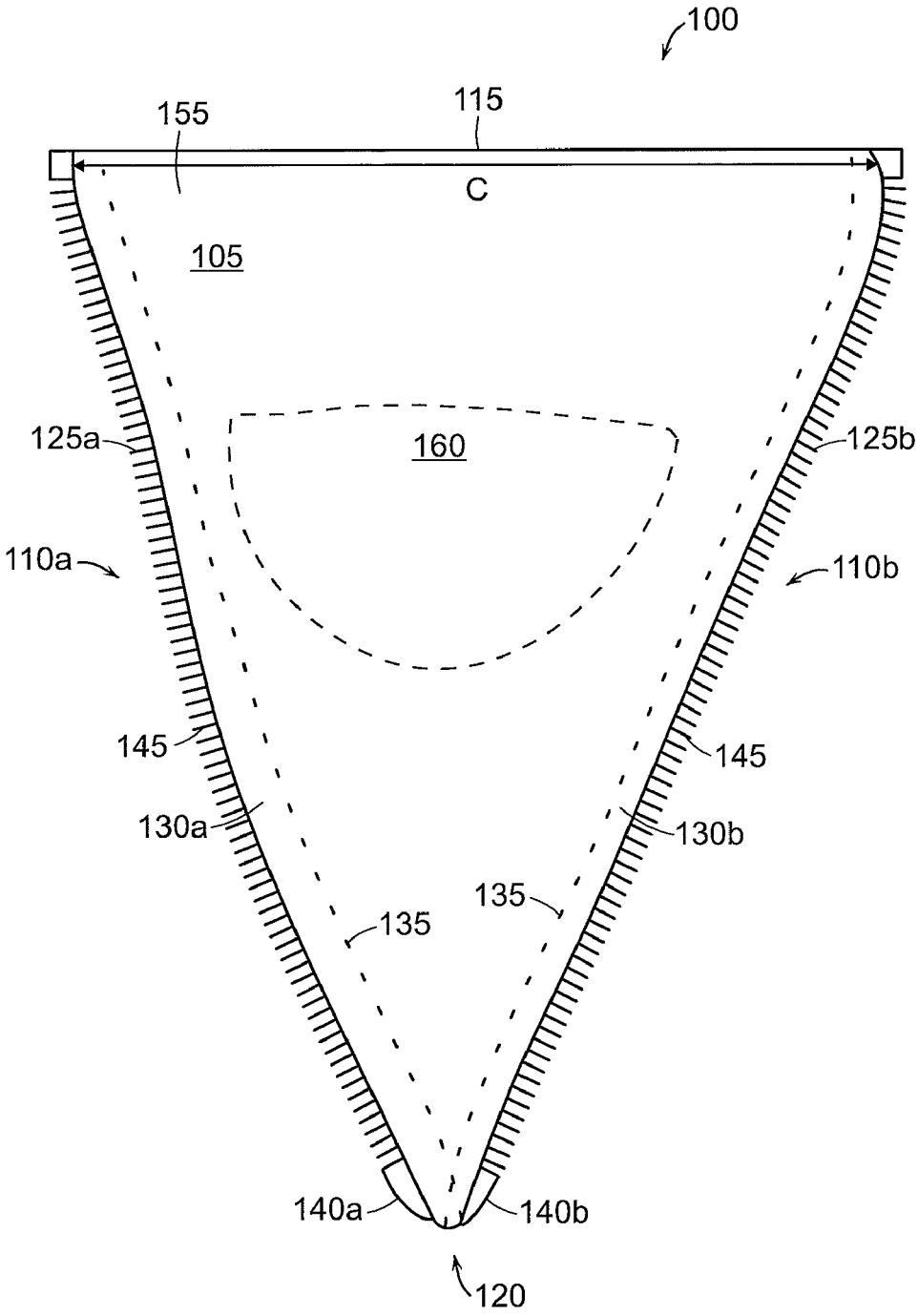

FIGS. 1A and 1B are plan views of an insert 100 that embodies the invention. The insert 100 includes a body 105. The body 105 is formed of a flexible material or fabric. In some embodiments, the flexible material is a stretchable material such as an elastic material, a spandex material, a LYCRA™ material, or other stretchable materials. The flexible material can also be a non-stretchable material, for example, nylon, nylon canvas, leather, cotton, polyester, cotton blends, or other types of material apparent to those of skill. In some embodiments, the type of material is selected based on the material of the article of clothing (not shown) with which the insert 100 will be used. For example, if the insert 100 is to be used with a leather boot, the insert 100 can be formed of a leather material.

The body 105 includes a first edge 110*a* and a second edge 110*b* (collectively 110). The body 105 also includes a top edge 115. The top edge 115 defines a circumferential dimension C. As illustrated, the edges 110 taper away from the top edge 115 to a point 120. In some embodiments, the point 120 is also a bottom edge (not shown). In such embodiments, the bottom edge also includes a circumferential dimension (not shown) that can be substantially the same size as the top edge circumferential dimension C or a different size (e.g., larger or smaller than C). Collectively, the edges 110, top edge 115, and point 120 form a perimeter of the body 105. In some embodiments, the perimeter of the body 105 can be different values to facilitate different sizes for the insert 105 (e.g., in some embodiments, the edges 110 are longer than the circumferential dimension C of the top edge 115, or the length of the edges 110 can remain the same while the circumferential dimension C of the top edge 115 differs). Additionally, the circumferential dimension C can have different values depending on the amount of expansion that is preferred by the wearer. The length or size of the edges 110 can depend, for example, on the dimensions of the article of clothing (e.g., the edges 110 can be made a first length for a mid-calf boot and a second length for a full-calf boot). Other size and dimensional changes are within the scope of the invention.

The insert 100 also includes a first fastener 125*a* disposed along the first edge 110*a* and a second fastener 125*b* disposed along the second edge 110*b*. The first fastener 125*a* is a zipper tape 130*a*, and the second fastener 125*b* is also a zipper tape 130*b*. Other types of fasteners are within the scope and spirit of the invention and will be apparent, for example, snaps, buttons, VELCRO, laces, clasps, hooks, or magnets. The first fastener 125*a* and the second fastener 125*b* (collectively 125) are secured to the body 105 by stitching 135. Other ways to secure the fasteners 125 to the body 105 will be apparent, for example, gluing, bonding, or mechanical fasteners such as pins, staples, tacks, zippers or snaps.

The first zipper tape 130*a* includes a first insert pin 140*a* and the second zipper tape 130*b* includes a second insert pin 140*b*. The first insert pin 140*a* and the second insert pin 140*b* (collectively 140) permit and facilitate coupling between the fasteners 125 and corresponding fasteners (not shown) on an article of clothing (not shown). The first zipper tape 130*a* and the second zipper tape 130*b* (collectively 130) also include zipper teeth 145. The zipper tape 130 can be made from a variety of materials such as, for example, nylon, metal, coil, mesh, or fabric material, or combinations of these. The zipper teeth 145 can similarly be made from a variety of materials such as metal, plastic, molded plastic, coil (e.g., nylon coil), or other materials suitable for a zipper. Examples of metals include brass, aluminum, antique brass, nickel, or steel.

Figure 6B:
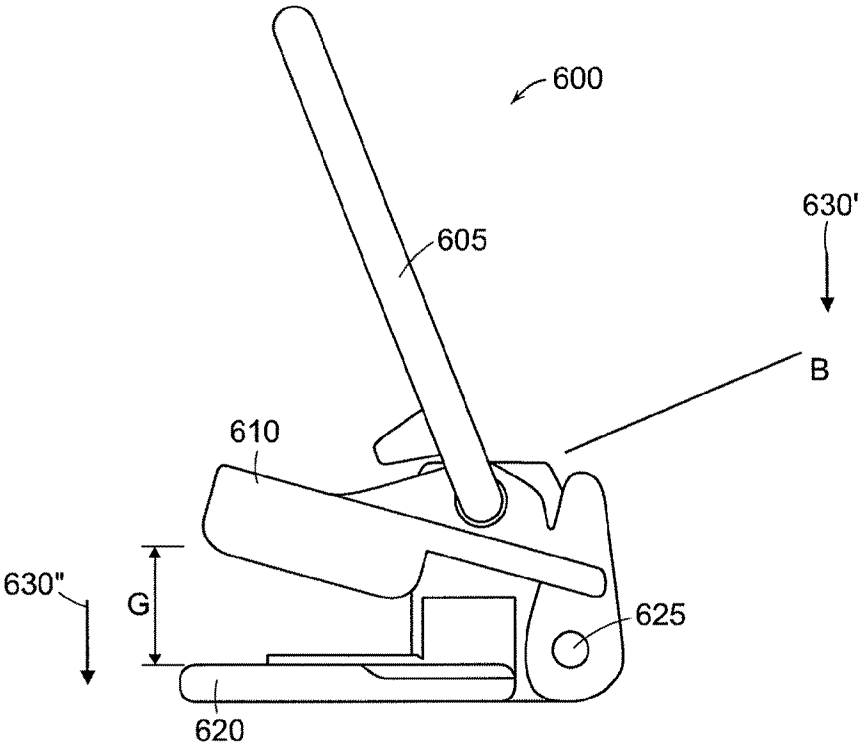
FIG. 6B is a perspective view of a zipper slider in an open position for use with an insert.
Figure 6A:
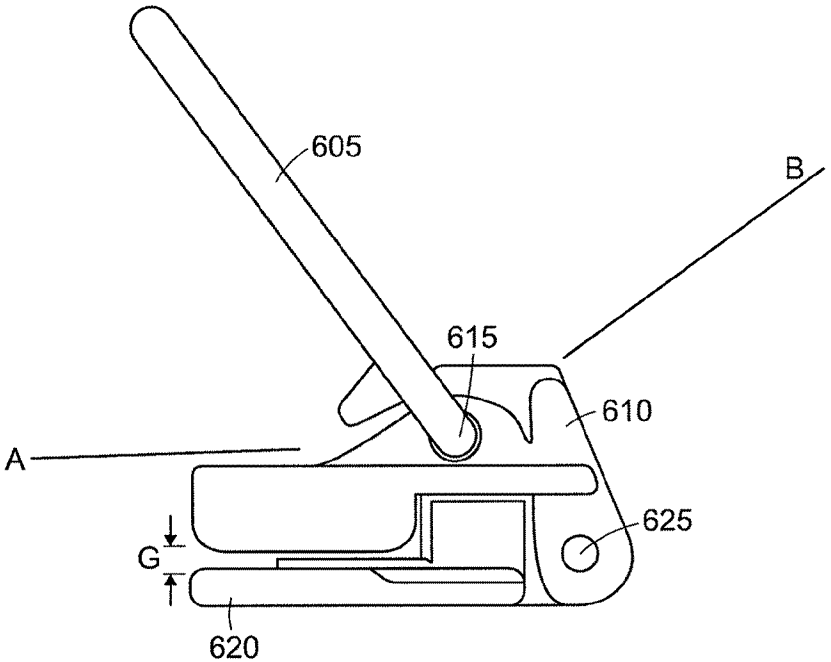
FIG. 6A is a perspective view of a zipper slider in a closed position for use with an insert.
Figure 6C:
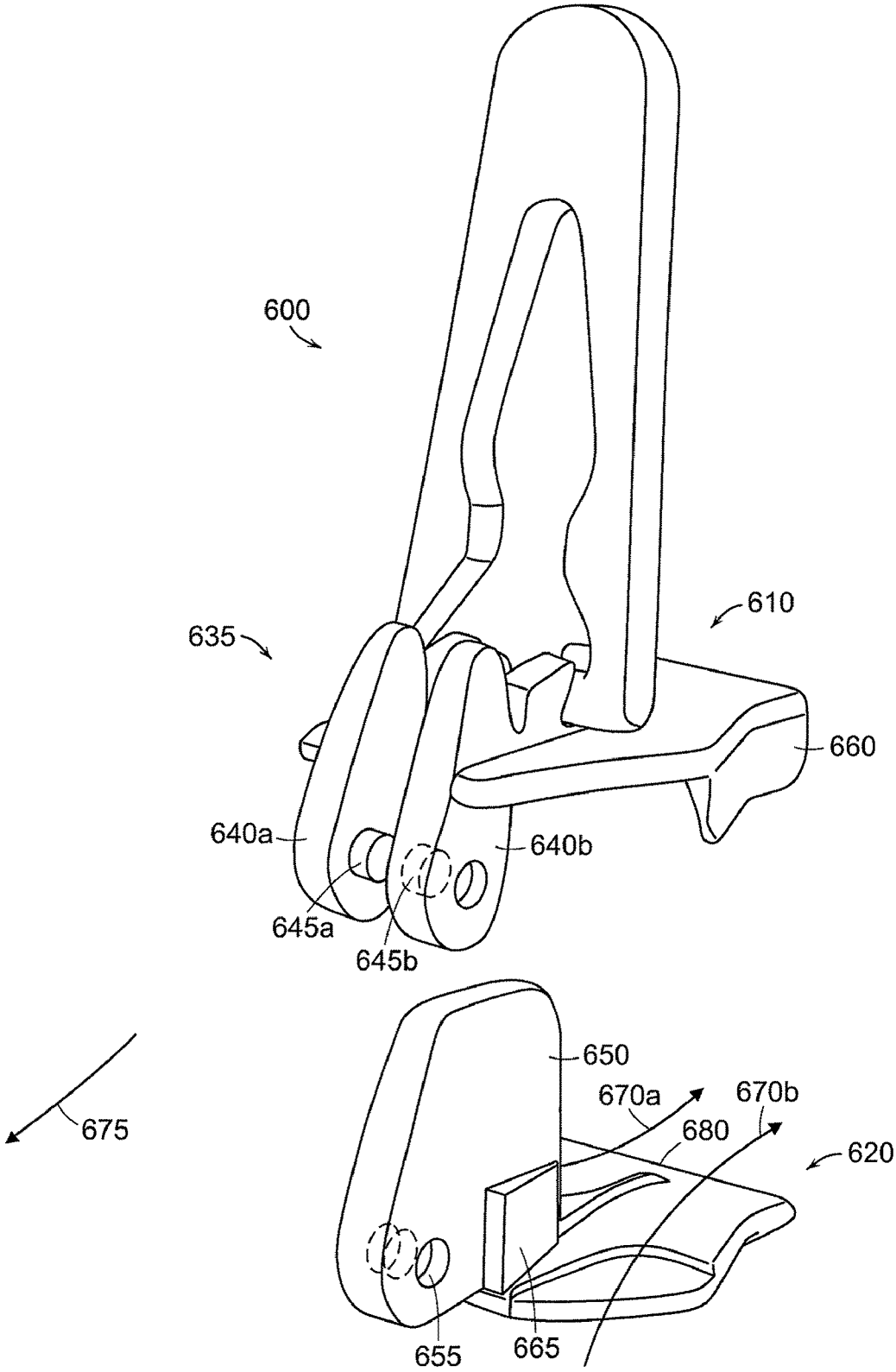
FIG. 6C is an exploded perspective view of the zipper slider of FIGS. 6A-6B.

The fasteners 125 also each include a zipper slider (not shown) that slides along the zipper tape 130 and zipper teeth 145 from the point 120 to the top edge 115 and vice versa. An exemplary zipper slider is illustrated in FIG. 6A-6C. The zipper slider can be made from any of a variety of materials such as metal, plastic, or fabric-like materials and can have different sizes and shapes without departing from the scope of the invention. The zipper slider can open (e.g., via a hinge or pivot structure), to facilitate attachment to the zipper tape 130 and zipper teeth 145 of the insert 100 as well as the zipper tape (not shown) and zipper teeth (not shown) of the corresponding article of clothing. In general, zippers come in a variety of sizes, and the particular zipper teeth 145 and zipper slider are matched to the size of the corresponding fasteners (e.g., zipper) on the article of clothing. Exemplary zipper sizes for typical articles of clothing and footwear include YKK-sized zippers, including sizes from YKK #3 to YKK #4.5, YKK #5 and YKK #10. In some embodiments, either the first fastener 125*a*, the second fastener 125*b*, or both are two-way zippers that include two zipper sliders (not shown). Decorative elements such as, for example, rhinestones or sparkles can be attached to the zipper or zipper sliders.

When the insert 100 is secured to the article of clothing, the circumferential dimension C serves to expand or augment a size of the article of clothing (e.g., an outer circumference of the article of clothing), while at the same time providing support to the article of clothing about the wearer's body (e.g., leg).

In some embodiments, any of the zipper tape 130, the zipper teeth 145, the body 105, the edges 110, the top edge 115 or the stitching 135 can be selected to be decorative (e.g., a decorative color, design, fabric type, or finish). Any of these components can be selected to match, complement, correspond, or coordinate with an article of clothing or accessory. The body 105 also includes an adornment region or adornment portion 150 or a pocket 160. The adornment region 150 can be any suitable shape or size, and the adornment region can include a material or structure that facilitates coupling ornamental features or items to the body 105. For example, the adornment region 150 can be made from a VELCRO material. In some embodiments, ornamental items such as, for example, charms, fabric swatches, buttons, rhinestones, sparkles, magnets, or dangly items can be attached to the adornment region 150.

As illustrated, the adornment region 150 is positioned on the outward-facing surface 155 of the insert 100 (e.g., the surface not in contact with the body of the wearer). On the opposite face (not shown) of the insert 100 is the inward-facing or body-facing surface (not shown) of the insert. In some embodiments, the outward-facing surface 155 and the inward-facing surface are made from different materials. Generally, the inward-facing surface includes a material that is soft or comfortable to the touch because the inward-facing surface can come into contact with the skin of the wearer. For example, the inward-facing surface can be made from a cotton material while the outward-facing surface 155 is made from a leather material. Other examples of suitable materials for the inward-facing surface include spandex, LYCRA™, elastic, or polyester blends. In some embodiments, the inward-facing surface includes a pattern or design selected to match, complement, correspond to, or coordinate with another pattern or design (e.g., the pattern or design native to the article of clothing or an accessory, such as the lining of a purse or handbag).

Figure 2:
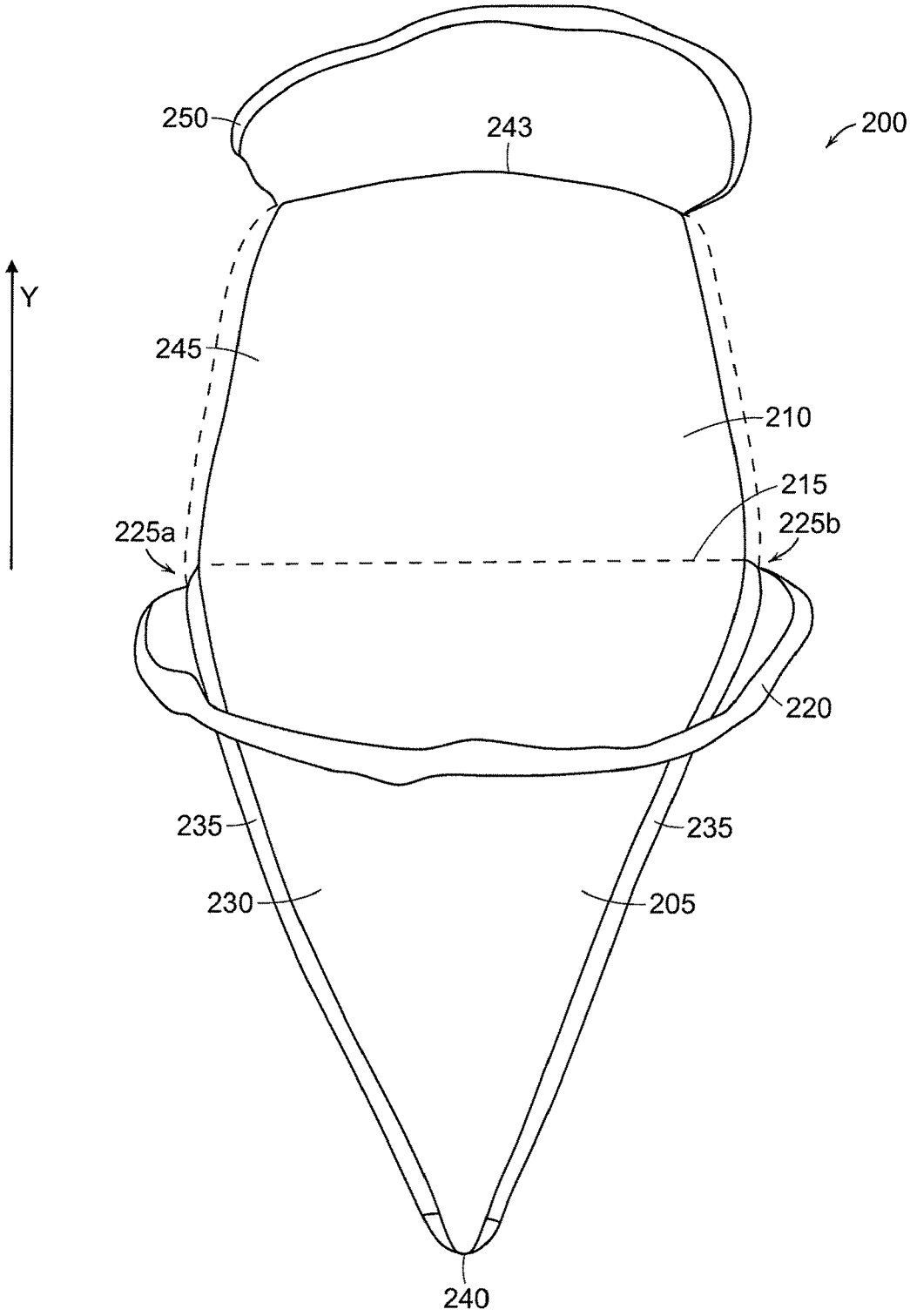
FIG. 2 is a plan view of an alternative insert according to an illustrative embodiment of the invention that includes a concealing portion or a concealable portion and an elongated portion.

FIG. 2 is a plan view of an alternative insert 200 according to an illustrative embodiment of the invention. The insert 200 includes a first body portion 205 and a second body portion 210 that extends upwards along the y-axis from the first body portion 205. The first body portion 205 includes a top edge portion 215. The first body portion 205 and the second body portion 210 can be formed from flexible materials. In some embodiments, the first body portion 205 and the second body portion 210 are formed from the same type of material or formed integrally (e.g., manufactured from the same piece of material). The first body portion 205 and the second body portion 210 can be formed from different types of materials. The second body portion 210 can be secured or fastened to the first body portion 205, for example, along the top edge 215. For example, the second body portion 210 can be secured to the first body portion by bonding, gluing, or via mechanical fasteners such as buttons, snaps, clasps, VELCRO, zippers, or other types of securing mechanisms.

The insert 200 also includes an elongated portion 220 that is connected to a first edge 225*a* and a second edge 225*b* (collectively 225) of the first body portion 205 or the second body portion 210. As illustrated, the first edge 225*a* and the second edge 225*b* are generally collinear along the extent of the first body portion 205 and the second body portion 210, but this is not necessarily required. The elongated portion 220 can be secured to the first edge 225*a* and removably securable to the second edge 225*b* or vice versa. The elongated portion 220 can be relatively permanently secured via stitching, bonding, gluing, or other permanent techniques. The elongated portion 220 can be removably coupled to the insert 200 via snaps, buttons, hooks, VELCRO, a zipper, clasps, or other mechanical means. The elongated portion can be a strap, a lace, or some other type of structure that wraps around the leg of a wearer to comfortably provide additional support or decoration for the insert 200. Although the elongated portion 220 is depicted in FIG. 2 as secured to the insert 200 at the intersection of the top edge portion 215 and the edges 225, other orientations and positions for the elongated portion 220 will be apparent and are within the scope of the invention.

As illustrated, the elongated portion 220 is positioned near the inward-facing surface 230 of the insert 200. The insert also includes an outward-facing surface (not shown). When the insert 200 is fastened to an article of clothing, such as a piece of footwear or a boot, the elongated portion 220 can be wrapped or tied around the body (e.g., the calf or shin) of the wearer to provide additional support and closure. To facilitate securing the insert 200 to the article of clothing, the elongated portion 220 is decoupled from the first edge 225*a* or second edge 225*b*, wrapped around the leg of the wearer, and reattached to the edge 225 from which the elongated portion 220 was previously decoupled.

As illustrated, the body portion 205 includes a zipper tape 235 along each edge 225 extending from the bottom portion 240 of the body portion 205 to the top edge portion 215. In some embodiments, the zipper tape 235 extends from the bottom portion 240 to the outside edge 243 of the second body portion 210 along each edge 225.

During installation, the first edge 225*a* and the second edge 225*b* are secured to the fastening structure (not shown) of the article of clothing, as discussed above with respect to FIG. 1 (e.g., by securing the zipper tape 235 to the zipper structure of the article of clothing). Upon installation, according to some embodiments, the top edge portion 215 is generally aligned with an outside edge or perimeter (not shown) of the article of clothing (e.g., the top edge of the leg-covering portion of a boot). The second body portion 210 extends above or past the outside edge or perimeter of the article of clothing. In some embodiments, the second body portion 210 defines an outward-facing surface 245 that can be folded over the outward-facing surface of the insert 200 upon installation, generally along the top edge portion 215. The second body portion 210 can thus be used to conceal certain features of the insert 200 as installed upon the article of clothing. In some embodiments, the outward-facing surface 245 includes an adornment region (not shown) that includes a structure (not shown) that facilitates coupling ornamental or decorative features to the insert 200. Thus, the outward-facing surface 245 of the insert is visible on the outer surface of the article of clothing.

In some embodiments, including the illustrated embodiment, the insert 200 includes a second elongated portion 250 coupled to the second body portion 210 at edge 243. The second elongated portion 250 can be secured to the edge 243 and removably coupled to the edge 243 or vice versa, to facilitate securing the second elongated portion 250 and the second body portion 210 to the leg of a wearer (e.g., the mid-calf or ankle of the wearer) in a fashion similar to that described above for the elongated portion 220. In some embodiments, the second elongated portion 250 is positioned at an intersection between edges 225 and edge 243. The second elongated portion 250 can also be positioned along edges 225 of the second body portion 210. The second elongated portion 250 is not required. Both the elongated portion 220 and the second elongated portion 250 can be made from a variety of materials, patterns or designs selected to match, complement, coordinate with or correspond to other portions of the insert 200, article of clothing, or accessories thereto.

The second body portion 210 can also be positioned between the inward-facing surface 230 of the first body portion 205 and the leg of the wearer. In such an embodiment, the outward-facing surface 245 of the second body portion 210 is folded inwardly towards the inward-facing surface 230 of the first body portion 205 (e.g., between the leg of the wearer and the insert 200). After folding, the second body portion 210 is concealed within the article of clothing and not necessarily visible. Specifically, the inward-facing surface 230 of the first body portion 210 and the outward-facing surface 245 of the second body portion 205 are in contact within the article of clothing. The insert 200 may not include the second elongated portion 250 in such an embodiment.

Figure 3:
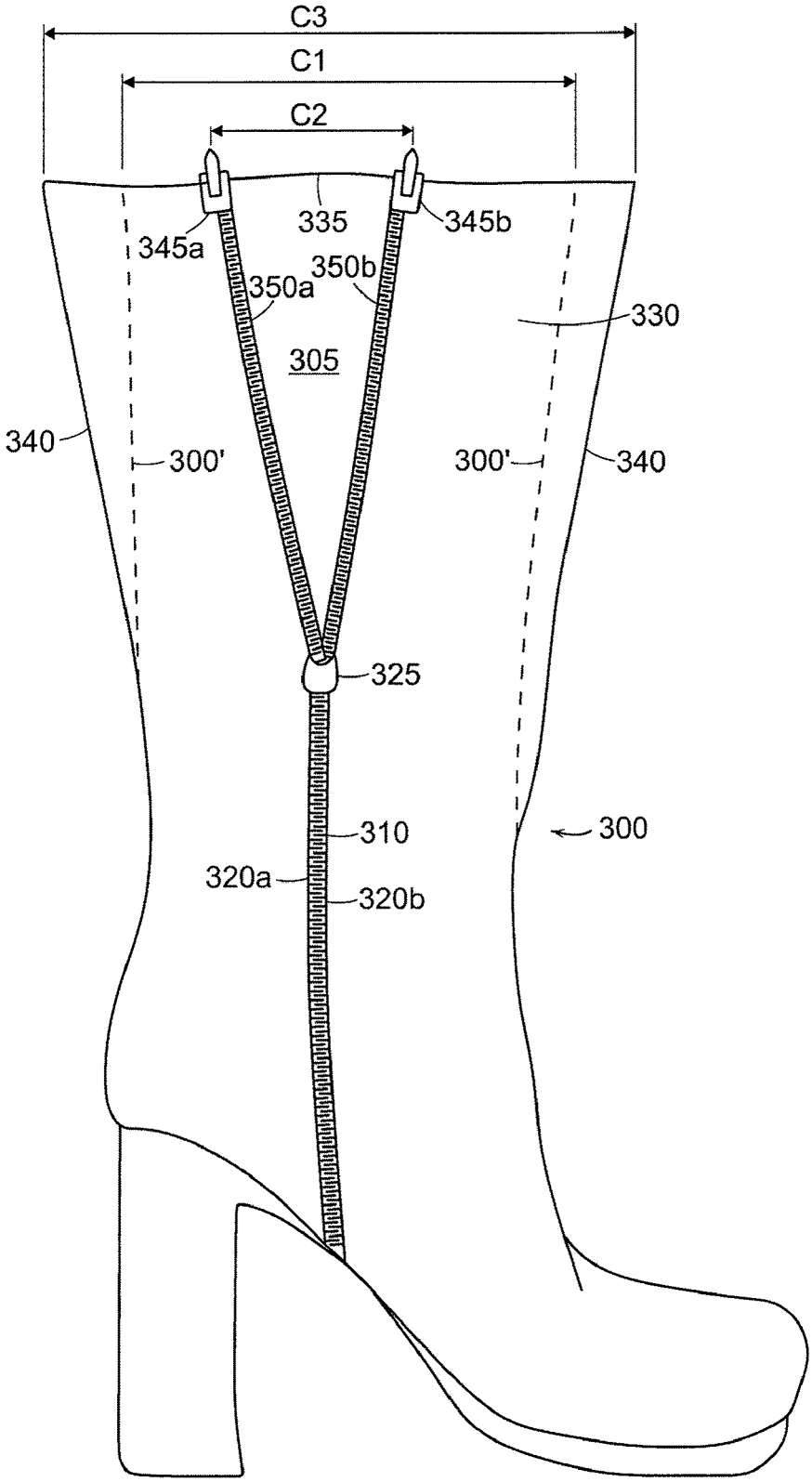
FIG. 3 is an elevational view of a boot including an insert.

FIG. 3 is an elevational view of a boot 300 including an insert 305. The boot includes a fastener structure 310. As illustrated, the fastener structure 310 is a zipper with a first zipper structure 320*a* (including zipper tape and zipper teeth) and a second zipper structure 320*b* (including zipper tape and zipper teeth) (collectively 320) and a zipper slider 325. The fastener structure 310 can include other types of securing or fastening mechanisms, such as, for example, buttons, snaps, hooks, clasps, VELCRO, or any combination of this, either in combination with the zipper structure 320 or as a substitute for the zipper structure 320. Without the insert 305, the zipper slider 325 operates to fasten the first zipper structure 320*a* to the second zipper structure 320*b*, thereby securing the leg-covering portion 330 of the boot about a leg of a wearer (not shown).

The leg-covering portion 330 defines an outer circumference $C_1$ when the boot 300 is worn without the insert 305. The shape of the boot 300 without the insert 305 illustrated by dotted lines 300'. The insert 305 includes a top edge 335 that defines a circumferential portion $C_2$. When the insert 305 is fastened to the boot 300 (e.g., the leg-covering portion 330 of the boot 300), the circumferential extent $C_3$ of the boot 300 expands, facilitating securing the leg-covering portion 330 about the leg of the wearer. The shape of the boot 300 with the insert 305 in use is illustrated by lines 340. As can be seen in FIG. 3, the insert 305 expands the size of the wearer's leg that the boot 300 can accommodate.

The insert 305 is secured to the boot 300 by a first zipper slider 345*a* and a second zipper slider 345*b* (collectively 345). The zipper sliders 345 can be, for example, the zipper slider illustrated in FIG. 6 that "opens" about a hinged structure to facilitate securing the zipper slider 345 to the zipper structure 320 of the boot 300. The insert 305 includes a first zipper structure 350*a* and a second zipper structure 350*b*. When the zipper slider 345*a* is in the open position, the first zipper structure 350*a* of the insert is positioned near the zipper structure 320*a* of the boot 300. The zipper slider 345*a* is moved to the closed position with teeth from the zipper structure 320*a* and zipper structure 350*a* therein. The zipper slider 345*a* can then be moved towards the top edge 335 of the insert 305 to fasten the zipper structure 320*a* to the zipper structure 350*a* (and to fasten the insert 305 to the leg-covering portion 330 of the boot 300). The zipper slider 345*b* couples the zipper structure 320*b* of the leg-covering portion 330 of the boot 300 to the zipper structure 350*b* of the insert 305 similarly to secure the leg-covering portion 330 about the leg of the wearer.

Figure 4:
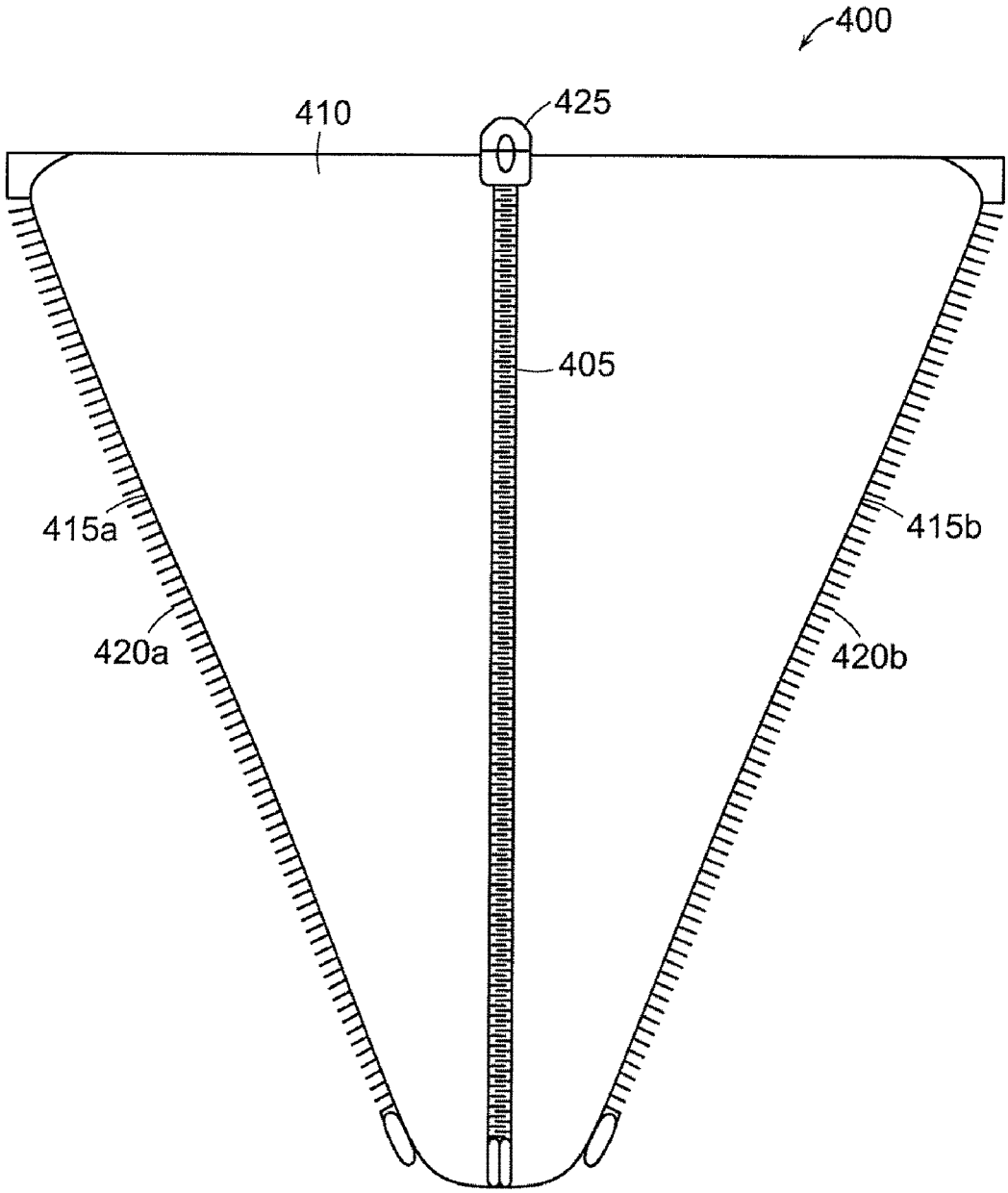
FIG. 4 is a plan view of an alternative insert that includes a fastening structure disposed relative to a flexible body.

FIG. 4 is a plan view of an alternative insert 400 that includes a fastening structure 405 disposed relative to a flexible body 410. The body 410 includes a first edge 415*a* that includes a first fastening structure 420*a* and a second edge 415*b* that includes a second fastening structure 420*b*. As discussed above, the first fastening structure 420*a* and the second fastening structure 420*b* are used to attach the insert 400 to an article of clothing such as a boot (not shown).

The fastening structure 405 positioned between the first edge 415*a* and the second edge 415*b* is illustrated as a zipper structure, but other fasteners are within the scope of the invention, e.g., snaps, hooks, clasps, laces, VELCRO, buttons, or any combination of these. In some embodiments, the fastening structure 405 aligns with the fastening structure of the article of clothing, for example, the fastening structure 310 of the boot 300 of FIG. 3. The fastening structure 405 can thus give the appearance of a continuous fastening structure (e.g., fastening structure 310 of the boot 300 and fastening structure 405 of the insert 400) on the article of clothing. In some embodiments, the fastening structure 405 is not necessarily aligned with the fastening structure of the article of clothing. As discussed above and elsewhere herein, the body 410 can be made from any of a variety of materials and/or designs that are selected for functional or decorative purposes. The fastening structure 405 includes a zipper slider 425 that is used to open and close the fastening structure 405.

Figure 5:
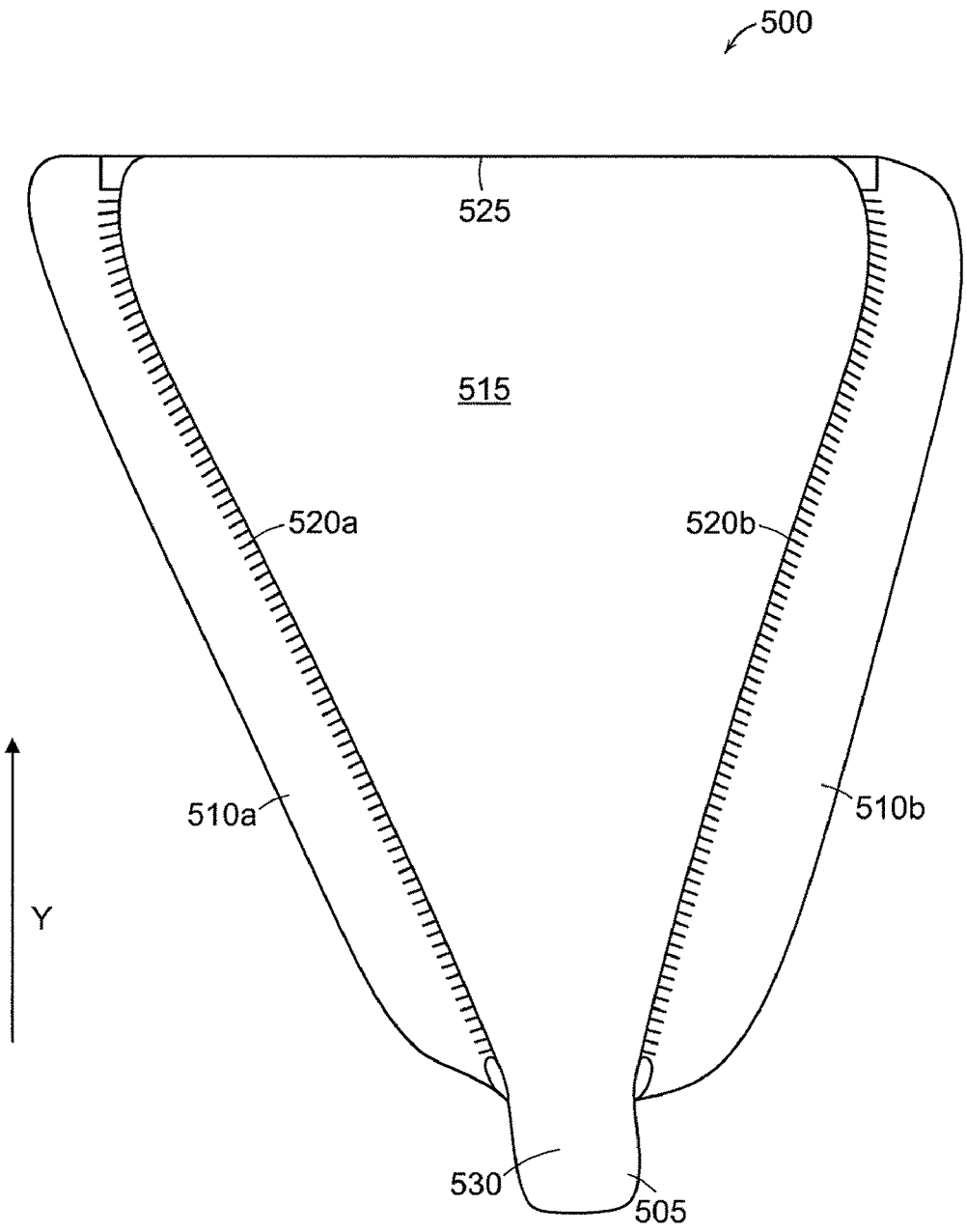
FIG. 5 is a plan view of an alternative insert that includes both a portion to conceal a portion of the fastening structure of a boot and portions to conceal the structures that fasten the insert to the boot.

FIG. 5 is a plan view of an alternative insert 500 that includes both a bottom portion 505 to conceal a portion of a fastening structure of a boot and portions 510*a*-510*b* to conceal the structures that fasten the insert 500 to the boot. The insert 500 includes an inward-facing surface 515 that faces an interior (not shown) of a boot when the insert 500 is attached to the boot (e.g., facing and/or contacting the leg of the wearer). The insert 500 includes a first fastening structure 520*a* and a second fastening structure 520*b* (e.g., zippers) that secure the insert 500 to the boot, for example, as described above.

The first fastening structure 520*a* is positioned near the portion 510*a*, and the second fastening structure 520*b* is positioned near the portion 510*b*. The portions 510*a*-510*b* are generally parallel to the inward-facing surface 515 and are designed to conceal the first and second fastening structures 520*a*-520*b* when the insert 500 is attached to the boot (e.g., when the first and second fastening structures 520*a*-520*b* are coupled to the corresponding fastening structures (not shown) on the leg-covering portion (not shown) of the boot. In this way, the fastening structures 520*a*-520*b* of the insert 500 and the fastening structure of the boot are disposed between the exterior surface (not shown) of the boot and the inward-facing portions 510*a*-510*b*. In some embodiments, the portions 510*a*-510*b* include a securing structure (not shown) to secure the portions 510*a*-510*b* of the boot. For example, the portions 510*a*-510*b* can include snaps, hooks, buttons, VELCRO or some other structure to couple to a corresponding structure of the boot (provided the boot includes such a structure). The portions 510*a*-510*b* can also be made from a relatively stiff material to ensure that the portions 510*a*-510*b* remain positioned to conceal the portions 520*a*-520*b* of the insert and corresponding fastening structure on the boot.

The insert 500 also includes the bottom portion 505 that extends downwardly along the y-axis away from the top edge 525 of the insert 500. The bottom portion 505 can be used to conceal a zipper slider (not shown) on the fastening structure of the boot (e.g., the zipper slider 325 of the boot 300 in FIG. 3). For example, the zipper slider can be concealed (e.g., tucked) between the exterior surface of the boot's fastening structure and the inward-facing surface 530 of the portion 505. The bottom portion 505 can include a securing structure (not shown) to couple to a corresponding securing structure of the boot (e.g., if the boot includes such a structure) to secure the bottom portion 505 in position. In some embodiments, the bottom portion 505 includes a relatively stiff material that positions the bottom portion 505 relative to the zipper slider of the boot. In some embodiments, the bottom portion 505 includes a magnet for magnetic coupling to the zipper slider of the boot to keep the bottom portion 505 and/or the boot's zipper slider in position.

In some embodiments, the insert 500 includes either the concealing portions 510*a*-510*b* or the bottom portion 505 but not both.

FIG. 6A is a perspective view of a zipper slider 600 for use in an insert in a closed position. The zipper slider 600 includes a zipper pull 605 that is coupled to a top component 610. The zipper pull 605 can rotate about a pivot point 615. The zipper pull 605 can rotate from a first position generally parallel to Line A to a second position generally parallel to Line B, or any position therebetween.

The zipper slider 600 also includes a bottom component 620. The bottom component 620 is spaced from the top component 610 by a gap G in the closed position of FIG. 6A. The gap G allows a portion of a zipper (not shown), such as a zipper tape and zipper teeth to pass through the zipper slider 600 for fastening (e.g., or allows the zipper slider 600 to pass over the zipper for fastening). The bottom component 620 is coupled to the top component 610 via a pivot structure 625. The pivot structure 625 allows the zipper slider 600 to be moved from the closed position of FIG. 6A to the open position of FIG. 6B.

FIG. 6B is a perspective view of a zipper slider for use in an insert in an open position. To move the zipper slider 600 from the closed position of FIG. 6A to the open position of FIG. 6B, the top component 610 is rotated or pivoted about the pivot structure 625 away from the bottom component, thus increasing a size of the gap G between the top component 610 and the bottom component 620. The larger size of the gap G in the open position allows the zipper (e.g., two zipper tapes and/or zipper teeth) to be decoupled from the zipper slider 600. The zipper slider 600 can be removed by moving the zipper slider 600 in the direction of the uncoupled zipper (e.g., towards the unfastened portions of the zipper and away from the fastened or coupled portion of the zipper). In some embodiments, the zipper slider 600 is moved to the open position of FIG. 6B by positioning the zipper pull 605 near the Line B and applying a pressure to the zipper pull 605 in the direction indicated as 630' while at the same time applying a pressure to the bottom component 620 in the direction indicated as 630" to move the top component 610 about the pivot structure 625 and increasing the size of the gap G.

In the open position of FIG. 6B, the zipper slider 600 can also be positioned relative to two uncoupled zipper structures or fasteners and moved into the closed position of FIG. 6A to facilitate coupling of the zipper structures. Thus, the zipper slider 600 can be used to couple a fastener (not shown) of an insert (not shown) to a corresponding fastener (not shown) of an article of clothing (not shown). By way of example, the detailed operation of the zipper slider 600 to couple an insert to an article of clothing can be seen with reference to FIG. 3.

In FIG. 3, the wearer inserts a foot into the boot 300 and moves the zipper slider 325 towards the top edge 335, thereby fastening the first zipper structure 320*a* to the second zipper structure 320*b* of the boot 300 to form the coupled fastener structure 310. The insert 305 is positioned between the first and second zipper structures 320*a*-320*b*. The zipper slider 600 (depicted as 345*a* in FIG. 3), in the open position of FIG. 6B is positioned such that the first zipper structure 320*a* of the boot 300 and the zipper structure 350*a* of the insert 305 are inside the zipper slider 600. The zipper structure 600 is then moved to the closed position of FIG. 6A and moved towards the top edge 335 of the insert 305, thereby coupling the first zipper structure 320*a* of the boot 300 and the first zipper structure 350*a* of the insert. A similar operation is used, with a second zipper slider 600 (depicted as 345*b* in FIG. 3) to couple the second zipper structure 320*b* of the boot 300 to the corresponding zipper structure 350*b* of the insert 305.

FIG. 6C is an exploded perspective view of the zipper slider 600 of FIGS. 6A-6B. The top component 610 includes a portion 635 of the pivot structure 625 of FIGS. 6A-6B. The portion 635 includes a first plate 640*a* and a second plate 640*b*. The first plate 640*a* includes a pivot point 645*a* and the second plate 640*b* includes a second pivot point 645*b*. The first pivot point 645*a* is disposed in a facing relation to the second pivot point 645*b* and is spaced therefrom to facilitate coupling to the corresponding plate 650 of the bottom component 620. The plate 650 of the bottom component 620 includes a bore 655 therethrough configured to accept the first pivot point 645*a* and the second pivot point 645*b* and allow rotational movement of the first and second pivot points 645*a*-645*b* about the bore 655. Rotation movement of the first and second pivot points 645*a*-645*b* facilitates rotational movement of the top component 610 relative to the bottom component 620, thereby facilitating movement of the zipper structure from the open position to the closed position, and vice versa.

It will be apparent to one of skill that the first and second plates 640*a*-640*b* could be formed as a part of the bottom component 620 and the corresponding plate 650 could be formed as part of the top component 610 without departing from the scope of the invention. An advantage realized by the zipper slider 600 of FIG. 6C derives from the use of pivot points 645*a*-645*b* to couple the top component 610 to the bottom component 620. Previous designs involved a bore (not shown) through the first and second plates 640*a*-640*b* to align with the bore 655 through the corresponding plate 650, and a pin (not shown) to be positioned through the aligned bores. The implementation illustrated in FIG. 6C removes the need for a separate pin component, which reduces the amount of material required and amount of assembly time required for the zipper slider 600.

The top component 610 includes an outer guide 660 for guiding a zipper structure (not shown) through the zipper slider 600. The bottom component includes an inner guide 665. The space between the outer guide 660 and the inner guide 665 when the zipper slider 600 is assembled defines a first opening (disposed on either side of the plate 650 and plates 640*a*-640*b*). Zipper structures are passed along lines 670*a* and 670*b* through the zipper slider 600 as the zipper slider 600 is moved in a direction generally parallel to 675. Moving the zipper slider 600 in a direction generally parallel to 675 facilitates coupling of the zipper structures as they pass through the first opening on either side of plates 640*a*-640*b*, 650 through a second, smaller opening near the back area 680 of the zipper slider 600. Moving the zipper slider 600 in a generally antiparallel to 675 facilitates de-coupling of the zipper structures as they pass from the smaller, second opening towards the larger first opening on either side of plates 640*a*-640*b*, 650.

In some embodiments, the top component 610, the bottom component 620, the zipper pull 605, or any other part of the zipper slider can be selected to be decorative or to match, complement, correspond, or coordinate with an article of clothing or an accessory.

Figure 7:
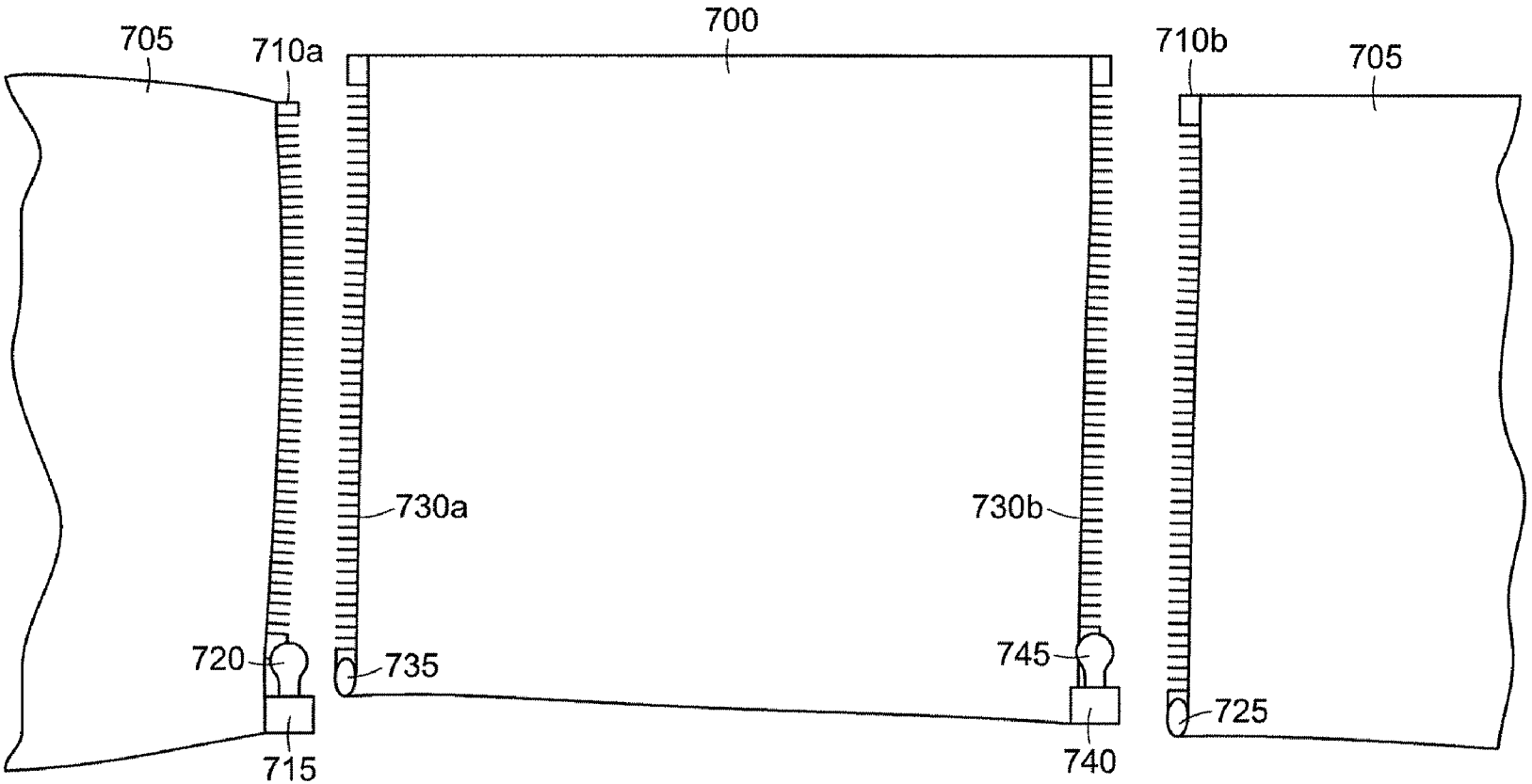
FIG. 7 is a plan view of an insert for an article of clothing, such as a jacket.

FIG. 7 is a plan view of an insert 700 for an article of clothing, such as a jacket 705. The jacket 705 includes a first zipper structure 710*a* that includes a retaining box 715 and a zipper slider 720. The zipper slider 720 can be the zipper slider with which the jacket 705 was manufactured. The jacket 705 includes a second zipper structure 710*b* that includes an insert pin 725. When the insert 700 is not used, the insert pin 725 slides through the zipper slider 720 and into the retaining box 715. The zipper slider 720 is then moved away from the retaining box 715 along the first and second zipper structures 710*a*-710*b* to facilitate coupling therebetween and sealing of the jacket 705.

The insert 700 includes a first zipper structure 730*a* that includes an insert pin 735. The insert 700 includes a second zipper structure 730*b* that includes a retaining box 740 and a zipper slider 745. The insert 700 is fastened to the jacket in the following, exemplary way. The insert pin 735 of the first zipper structure 730*a* of the insert 700 slides (or is slid) through the zipper slider 720 and retaining box 715 of the jacket 700. The zipper slider 720 is then moved away from the retaining box 715 along the first zipper structure 710*a* of the jacket 705 and the first zipper structure 730*a* of the insert 700 to facilitate coupling therebetween. The insert pin 725 of the second zipper structure 710*b* of the jacket 705 slides (or is slid) through the zipper slider 745 and retaining box 740 of the second zipper structure 730*b* of the insert 705. The second zipper slider 745 is moved away from the retaining box 740 along the second zipper structure 730*b* of the insert 705 and the second zipper structure 710*b* of the jacket 705 to facilitate coupling therebetween. In this way, the size (e.g., circumference) of the jacket can be increased without requiring tailoring or additional structural changes to the jacket. As discussed above with respect to other described inserts, the insert 700 can be decorative or include a variety of materials. The pattern or design can be selected to match, complement, correspond to or coordinate with accessories or articles of clothing. The insert 700 can include an adornment portion (not shown) that includes a structure for coupling decorative items to the insert 700.

Although FIG. 7 has been described in the context of a jacket 705, it will be apparent that the insert 700 can be used with other articles of clothing that include other types of fastener structures.

It will be appreciated by those of skill that any of the elements described herein can be selected based on the user's preference, including the material, size, color, pattern, design, or adornment features to add to various components. While not specifically set out for every possible combination above, components of disclosed structures (e.g., stitching attaching zipper structures to flexible bodies) can also be selected based on visual appearance or pleasing nature to the eye.

While the invention has been particularly shown and described with reference to specific embodiments, it should be understood by those skilled in the art that various changes in form and detail may be made therein without departing from the spirit and scope of the invention as defined by the appended claims.

The invention claimed is:

1. An insert for an article of footwear that includes a leg-covering portion defining an outer circumference and a closeable portion disposed relative to the outer circumference having a zipper structure that secures the leg-covering portion about a leg of a wearer, the insert comprising:

a body portion comprising a flexible material, the body portion defining a perimeter including a first edge and a second edge;

a first zipper disposed along the first edge and securable to a first portion of the zipper structure of the leg-covering portion of the article of footwear; and a second zipper disposed along the second edge securable to a second portion of the zipper structure of the leg-covering portion of the article of footwear, the perimeter of the body portion to increase a size of the outer circumference of the leg-covering portion when the first and second zippers are secured to the zipper structure, wherein the first zipper includes a first zipper track and a first slider portion that is configured to couple the first zipper track with a third zipper track of the zipper structure, and wherein the second zipper includes a second zipper track and a second slider portion that is configured to couple the second zipper track with a fourth zipper track of the zipper structure.

2. The insert of claim 1, wherein the first and second slider portions each include a top component coupled to a bottom component by a hinge or pivot structure.

3. The insert of claim 2, wherein the first hinge or pivot structure is configured to permit the first slider portion to open and facilitate coupling between the first and third zipper tracks and the second hinge or pivot structure is configured to permit the second slider portion to open and facilitate coupling between the second and fourth zipper tracks.

4. The insert of claim 1, wherein the first zipper track includes a first insert pin and the second zipper track includes a second insert pin.

5. The insert of claim 1, wherein the flexible material comprises at least one of nylon, nylon canvas, an elastic material, a leather material, a spandex material, a cotton material, a cotton blend material, or any combination thereof.

6. The insert of claim 1, wherein the flexible material comprises a color or design selected to match, complement, or correspond to an article of clothing or an accessory.

7. The insert of claim 1, wherein the body portion further comprises a second zipper structure disposed between the first edge and the second edge.

8. The insert of claim 7, wherein the second zipper structure and the zipper-structure of the leg-covering portion of the article of footwear are generally aligned when the insert is secured to the article of footwear.

9. The insert of claim 1, wherein the body portion includes an extensive region disposed between the first and second edges, the extensive region covering at least a portion of the zipper structure of the leg-covering portion of the article of footwear.

10. The insert of claim 1, further comprising an elongated portion coupled to the first edge and connectable to the second edge, the elongated portion positioned about the outer circumference of the leg-covering portion when the first and second zippers are secured to the zipper structure of the article of footwear.

11. The insert of claim 1, wherein the body portion defines a leg-facing surface and an exterior-facing surface.

12. The insert of claim 11, wherein the leg-facing surface and the exterior-facing surface comprise different materials.

13. The insert of claim 11, wherein the exterior-facing surface comprises a pocket.

14. The insert of claim 11, wherein the leg-facing surface comprises a spandex material, a cotton material, an elastic material, or any combination thereof.

15. The insert of claim 1, wherein the body portion further comprises an adornment portion facilitating removable or permanent coupling of ornamental items to the insert.

16. The insert of claim 15, wherein the adornment portion includes a structure facilitating removable or permanent coupling of ornamental items to the insert.

17. The insert of claim 1, wherein the body portion further comprises a concealable portion disposed between the first and second edges, the concealable portion extending vertically past the outer circumference of the article of footwear and foldable to fit between a leg-facing surface of the body portion and the leg of the wearer.

18. The insert of claim 1, wherein the body portion further comprises a concealing portion disposed between the first and second edges, the concealing portion configured to extend vertically past the outer circumference of the article of footwear and foldable over an exterior surface of the insert, an exterior surface of the leg-covering portion of the article of footwear, or both.

19. The insert of claim 18, wherein the concealing portion is detachably coupled to the body portion.

20. The insert of claim 1, wherein the perimeter includes a top edge region generally aligned with the outer circumference of the leg-covering portion when the insert is secured to the zipper structure and a bottom region remote from the top edge region, the first edge and the second edge forming a decreasing taper from the top edge towards the bottom region.

21. A zipper slider comprising:

a bottom component including a first opening disposed relative to a smaller second opening, the first opening for receiving first and second zipper structures, and the second opening for passing the first and second zipper structures therethrough;

a first pivot and a second pivot generally axially aligned with the first pivot and spaced therefrom, the first and second pivots disposed relative to the bottom component; and a top component including a pull structure to move the zipper slider along the first and second zipper structures in response to urging by a user, the top component coupled to the first and second pivots to facilitate opening or closing the device about the first and second pivots.

22. The zipper slider of claim 21, wherein the first and second pivots are formed integrally with the bottom or top component.

23. The insert of claim 1, wherein the flexible material of the body portion is a first zipper tape of a first zipper secured to a second zipper tape of a second zipper.

24. The insert of claim 1, wherein the first edge and the second edge form a decreasing taper, the first zipper and the second zipper extending past the taper.

25. An insert for an article of footwear that includes a leg-covering portion defining an outer circumference and a closeable portion disposed relative to the outer circumference having a zipper structure that secures the leg-covering portion about a leg of a wearer, the insert comprising:

a body portion comprising a flexible material, the body portion defining a perimeter including a first edge and a second edge;

a first zipper disposed along the first edge and securable to a first portion of the zipper structure of the leg-covering portion of the article of footwear;

a second zipper disposed along the second edge securable to a second portion of the zipper structure of the leg-covering portion of the article of footwear, the perimeter of the body portion to increase a size of the outer circumference of the leg-covering portion when the first and second zippers are secured to the zipper structure; and an elongated portion coupled to the first edge and connectable to the second edge, the elongated portion positioned about the outer circumference of the leg-covering portion when the first and second zippers are secured to the zipper structure of the article of footwear.

26. The insert of claim 25, wherein the flexible material comprises at least one of nylon, nylon canvas, an elastic material, a leather material, a spandex material, a cotton material, a cotton blend material, or any combination thereof.

27. The insert of claim 25, wherein the flexible material comprises a color or design selected to match, complement, or correspond to an article of clothing or an accessory.

28. The insert of claim 25, wherein the body portion further comprises a second zipper structure disposed between the first edge and the second edge.

29. The insert of claim 28, wherein the second zipper structure and the zipper-structure of the leg-covering portion of the article of footwear are generally aligned when the insert is secured to the article of footwear.

30. The insert of claim 25, wherein the body portion includes an extensive region disposed between the first and second edges, the extensive region covering at least a portion of the zipper structure of the leg-covering portion of the article of footwear.

31. The insert of claim 25, further comprising an elongated portion coupled to the first edge and connectable to the second edge, the elongated portion positioned about the outer circumference of the leg-covering portion when the first and second zippers are secured to the zipper structure of the article of footwear.

* * * * *